US006085661A

United States Patent [19]

Halverson et al.

[11] Patent Number: 6,085,661

[45] **Date of Patent: *Jul. 11, 2000**

[54] SMALL CALIBER NON-TOXIC PENETRATOR PROJECTILE

[75] Inventors: Henry J. Halverson, Collinsville; Anthony F. Valdez, Godfrey, both of Ill.

[73] Assignee: Olin Corporation, East Alton, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,131

[22] Filed: Oct. 6, 1997

[51] Int. Cl.[7] ..... F42B 12/04

[52] U.S. Cl. ..... 102/516; 102/518; 102/519

[58] Field of Search ..... 102/501, 514–519; 29/1.22, 1.23

[56] References Cited

U.S. PATENT DOCUMENTS

| | | | |
|---|---|---|---|
| 3,782,287 | 1/1974 | Sie | 102/518 |
| 4,619,203 | 10/1986 | Habbe | 102/517 |

FOREIGN PATENT DOCUMENTS

| | | | |
|---|---|---|---|
| 819445 | 8/1969 | Canada | 102/517 |
| 374726 | 6/1907 | France | 102/502 |
| 601686 | 5/1948 | United Kingdom | 102/514 |

OTHER PUBLICATIONS

Baumeister, "Mechanical Engineers'Handbook", Sixth Edition p. 5–5, 1958.

*Primary Examiner*—Harold J. Tudor
*Attorney, Agent, or Firm*—Wiggin & Dana; Gregory S. Rosenblatt

[57] ABSTRACT

A small caliber non-toxic penetrator projectile has a first core and a second core tandemly aligned and enveloped by a jacket. The first core has a hardness greater than the hardness of the second core that has a Brinell hardness of between about 20 and about 50. The hardness of the second core is significantly higher than the hardness of lead and when the first core strikes a target, the second core resists compressive bulging. As a result, more kinetic energy is transferred to the first core rather than diffused along the surfaces of an armored target. The more efficient transfer of kinetic enables the use of lower density second cores, such as annealed copper.

15 Claims, 3 Drawing Sheets

SMALL CALIBER NON-TOXIC PENETRATOR PROJECTILE

BACKGROUND OF THE INVENTION

1. Field of the Invention

This invention relates to a small caliber penetrator projectile. More particularly, the penetrator projectile has a jacket enveloping tandemly aligned cores. A forward core is harder than a rearward core having a Brinell hardness of between about 20 and about 50.

2. Description of Related Art

Small caliber, under 0.5 inch diameter, penetrator projectiles are used by military forces worldwide. The United States and NATO military forces use vast quantities of M855 cartridges containing 62 grain penetrator bullets. The M855 bullets have two tandemly aligned cores enveloped by a brass jacket. A steel core is located in a nose section of the bullet and a 32 grain lead core is swaged into a rear section. Typically, the tail portion of the bullet is angled for ballistic stability and improved aerodynamic performance. At a total weight of 62 grains, the M855 bullet has the kinetic energy required to penetrate a 10 gage steel plate when fired from a distance of 600 meters.

Penetrator projectiles are disclosed in U.S. Pat. No. 740,914 to Platz and in U.S. Pat. No. 5,009,166 to Bilsbury et al. Both the Platz and the Bilsbury et al. patent are incorporated by reference in their entireties herein.

When the steel core impacts a target, compressive forces cause the trailing lead core to bulge. The bulge in the lead core has a diameter larger than the hole formed through the target by the steel penetrating core. This causes the lead core to deform on the surface of the target, transferring momentum to the target surface rather than to the steel core.

Many penetrator rounds are expended at target ranges in military drills. The large volume of lead contained within the projectiles makes environmental reclamation of the target ranges difficult and expensive.

There remains, therefore, a need for a projectile penetrator that is not subject to the disadvantages of the prior art.

SUMMARY OF THE INVENTION

Accordingly, among the objects of the invention are to provide an improved non-toxic penetrator projectile and a method for the manufacture of that projectile. It is a feature of the invention that the projectile contains tandemly aligned first and second cores enveloped in a jacket. The forward core is harder than the rear core. The rear core has a Brinell hardness of between about 20 and about 50. Preferably, the two cores are unaffixed and separate following impact with a target.

Another feature of the invention is that the second core is sufficiently hard to resist deformation when the projectile strikes a target, yet is deformable by conventional mechanical bullet forming processes.

Among the advantages of the penetrator projectile and method of manufacture of the invention are that the projectile is substantially lead-free and does not constitute an environmental hazard. A second advantage is that the rear core is sufficiently hard to resist deformation, increasing the amount of kinetic energy transferred to the first core on impact with a hard target. Another advantage is that, in preferred embodiments, the two cores are unaffixed and function substantially independently following impact with a target. Still another advantage is that the projectile is readily manufactured by mechanical deformation processes.

In accordance with the invention, there is provided a small caliber projectile penetrator. The small caliber projectile penetrator has a first core and a second core in tandem alignment. The first core is harder than the second core with the second core having a Brinell hardness of between about 20 and about 50. A jacket envelopes both the first core and the second core with the jacket having an ogival nose portion adjacent to the first core and an angularly indented rear portion adjacent to the second core. A generally cylindrical side walls is disposed between the ogival nose portion and the angularly indented rear portion.

In accordance with a second embodiment of the invention, there is provided a method for the manufacture of a small caliber projectile penetrator. There is provided a jacket precursor having an ogival nose portion and generally a cylindrical sidewall. A first core is processed to a first hardness and a second core is processed to a second hardness. This second hardness is both less than the first hardness and between about 20 HB and about 50 HB. The first core and then the second core are sequentially inserted into the jacket precursor with the first core being adjacent to the ogival nose portion. The jacket precursor is then mechanically deformed to form a base crimp and an angularly indented rear portion adjacent to the second core.

The above stated objects, features and advantages will become more apparent from the specification and drawings that follow.

IN THE DRAWINGS

DETAILED DESCRIPTION

Figure 1:
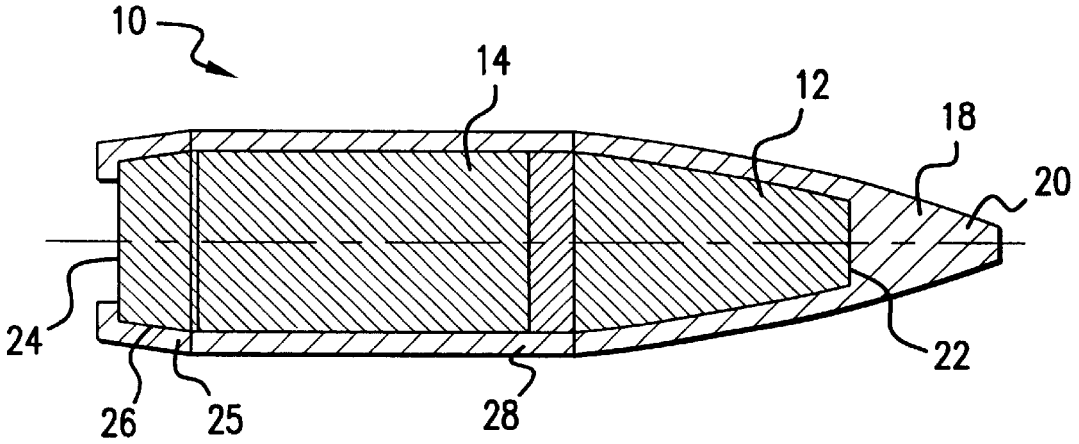
FIG.1 PRIOR ART
FIG. 1 shows in cross-sectional representation a small caliber penetrator projectile as known from the prior art.

FIG. 1 illustrates a penetrator projectile 10 from an M855 cartridge as known from the prior art. The penetrator projectile 10 has a first core 12 and a second core 14 tandemly arranged along a longitudinal axis 16 of the penetrator projectile 10.

The first core 12 is formed from-steel and the second core 14 formed from lead.

Enveloping the first core 12 and second core 14 is a brass jacket 18. The brass jacket 18 has an ogival nose portion 20 adjacent to a forward end 22 of the first core 12. In this patent application, the forward end refers to the end portion of a component that is closer to the nose of the penetrator projectile 10 during flight. The rearward end refers to the opposing portion of the component that is more distance from the nose of the penetrator projectile during flight.

Adjacent to the rear end 24 of the second core 14, a rear sidewall 25 of the brass jacket 18 is angularly indented for improved ballistic stability and aerodynamic flight including reduced air drag. This configuration is commonly referred to as a boattail. Disposed between the angular indentation 26 and the ogival nose portion 20 is a generally cylindrical mid-body sidewall 28.

Figure 2:
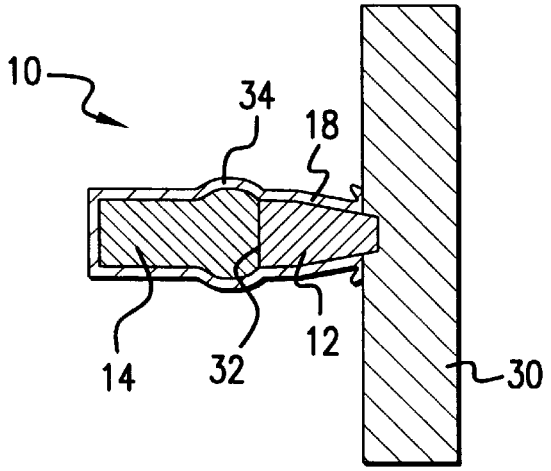
FIG.2 PRIOR ART
FIGS. 2 and 3 illustrate in cross-sectional representation mushrooming of a rear core as a defect with the prior art.

When the penetrator projectile 10 strikes an armored target, such as 10 gage steel, a number of defects impact performance. With reference to FIG. 2, when the first core 12 impacts an armored target 30, the velocity of the penetrator projectile 10 is rapidly reduced. The momentum of the second core 14 causes the soft lead of the second core to compressively deform against a rear end 32 of the first core 12 forming a bulge 34. Typically, the brass jacket 18 is peeled away as the cores enter the armored target.

Figure 3:
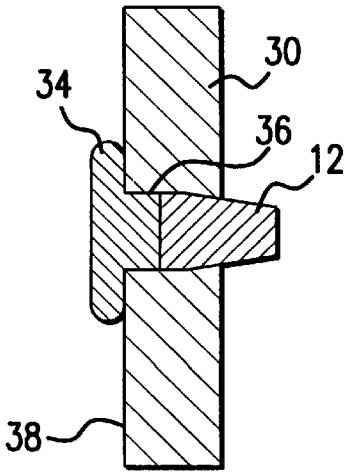
FIG.3 PRIOR ART

As illustrated in FIG. 3, the diameter of the bulge 34 is greater than the diameter of the hole 36 formed through the armored target 30 by the first core 12. The second core 14 splatters against a surface 38 of the armored target 30 and only a portion of its kinetic energy is transferred to the first core 12.

Figure 4:
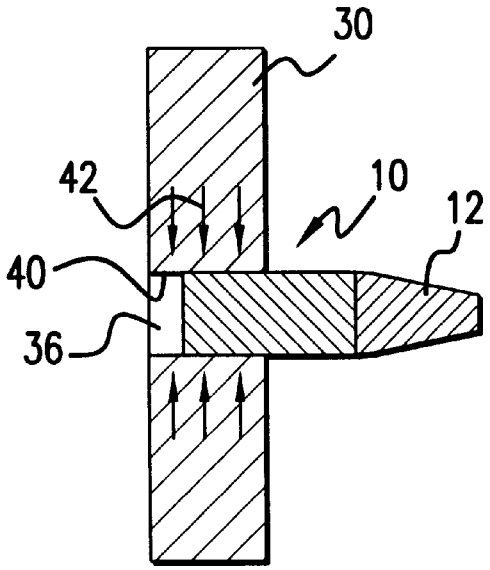
FIG.4 PRIOR ART
FIG. 4 illustrates in cross-sectional representation compression of a target causing a prior art penetrator to fail.

Another defect, that manifests when the core is a single piece or multiple pieces bonded together to function as a single piece, is illustrated in FIG. 4. As the first core 12 pierces the armored target 30 to form hole 36, the sidewall 40 is plastically and elastically deformed to accommodate the penetrator projectile 10. An opposing compressive force 42 develops against the sidewall, reducing the diameter of the hole 36. This compressive force 42 impedes travel of the penetrator projectile through the hole 36. If all kinetic energy of the penetrator projectile 10 is absorbed, the projectile is stopped while still partially embedded in the armored target 30. Since the penetrator projectile 10 is intended to cause damage inside a target, failure to penetrate target armor represents a failed round.

Figure 5:
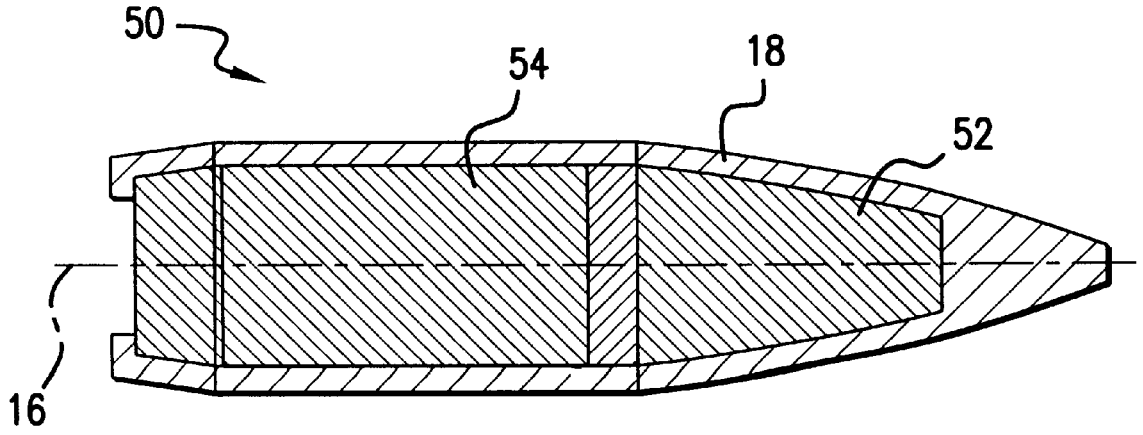
FIG. 5 illustrates in cross-sectional representation the penetrator projectile of the invention.

The penetrator projectile 50 of the invention is illustrated in FIG. 5. The penetator projectile 50 does not exhibit the disadvantages of the prior art. The penetrator projectile 50 has many components similar to the prior art penetator projectile illustrated in FIG. 1 and description of those similar components is not repeated. Rather the description of those similar components above is incorporated into the penetrator projectile 50.

The penetrator projectile 50 has a first core 52 and a second core 54. The first core 52 and second core 54 are tandemly aligned along the longitudinal axis 16 of the penetrator projectile 50 with the first core 52 being aligned forward of the second core 52. A jacket 18, typically brass (a copper/zinc alloy) or copper plated steel, envelopes the first core 52 and second core 54. The first core 52 is relatively hard. By relatively hard, it is meant that when the hardness is evaluated by standard testing means, at room temperature, the first core 52 is harder than the second core 54. Suitable materials for the first core include steel, tungsten and tungsten carbide.

The second core has a Brinell hardness of between about 20 and about 50 and most preferably, a Brinell hardness of about 35 to about 45. The Brinell hardness assigns a number, HB, related to the applied load and to the surface area of the permanent impression made by a ball indenter computed from the equation:

$$HB=2P/\Pi D\ (D^2-d^2)^{0.5}$$

P=the applied load in kilogram-force.

D=the diameter of an indenting ball in millimeters, and d=the mean diameter of an formed impression in millimeters.

If the Brinell hardness exceeds about 50 HB, then mechanical swaging processes utilized in standard bullet manufacture are ineffective to form a boattail. The boattail must then be cut or ground into the rear of the core and, during mechanical enveloping of the jacket around the excessively hard core, there is limited impinging of the jacket with the core. The result is a gap of up to 0.020 inch between the jacket and the boattail. When this projectile is fired, propellant gases are forced between the interface of the jacket and the core causing distortion of the jacket configuration resulting in loss of accuracy and stability. To prevent this distortion, a soft material, such as lead, must be forced into the base to obturate the propellant gases.

If the Brinell hardness of the second core is below about 20 HB, then bulging of the rear core and the loss of kinetic energy due to splatter occurs.

Suitable materials for the second core are malleable materials that include copper and copper alloys, bismuth/tin alloys, gold, silver, pewter (a tin/antimony/copper alloy) and organic polymers, such as nylon or rubber, filled with a powdered heavy metal, such as tungsten or copper. Most preferred is an annealed copper alloy, such as the copper alloy designated by the Copper Development Association (CDA) as copper alloy C10200 (99.95%, by weight, minimum copper) that has a Brinell hardness of about 42.

Less suitable as the second core are soft, compressible metals such as hardened lead (Brinell hardness of about 7) and tin (Brinell hardness of 4).

Figure 6:
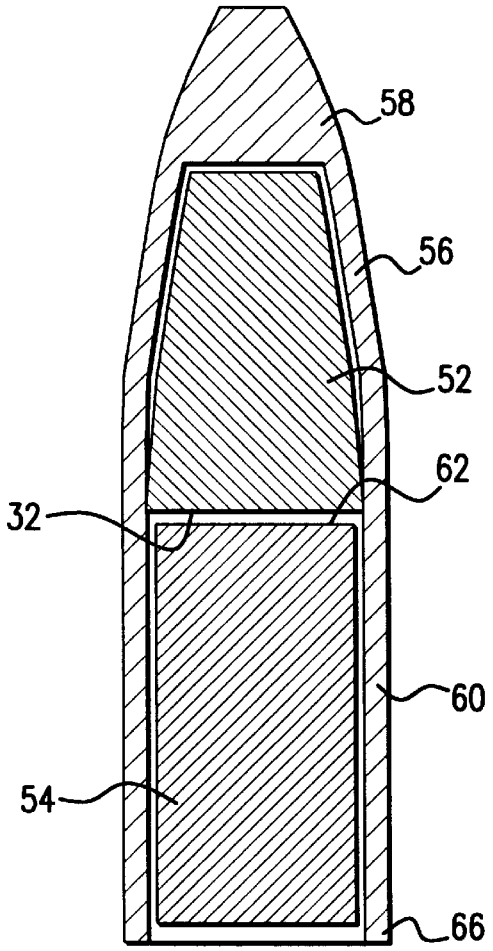
FIG. 6 illustrates in cross-sectional representation a method for the manufacture of the projectile penetrator of the invention.

A method for the manufacture of the projectile penetrator of the invention is illustrated in FIG. 6. A jacket precursor 56 is formed from a malleable metal such as brass or copper plated steel. The jacket precursor has an ogival nose 58, a cylindrical mid-body sidewall 60 and a rear sidewall 66. A first core 52 is processed to a first hardness, that is greater than the hardness of a second core 54. If the first core 52 is steel, the desired hardness may be achieved by a thermal process such as carbufizing or work hardening.

The second core 54 has a Brinell hardness of between about 20 and about 50, and preferably from about 35 to about 45 The two cores are then sequentially inserted into a cavity defined by the jacket precursor 56 with the first core 52 being disposed adjacent to the ogival nose portion 58. While the rear end 32 of the first core 52 may be bonded to the front end 62 of the second core 54, in preferred embodiments, the two cores are in abutting, but not affixed, relationship. A swaging die, or other mechanical deforming apparatus, then deforms the jacket precursor 56 into an effective jacket as described above in reference to FIG. 5. A crimp is formed from the rear sidewall 66 and mechanically secures the first core 52 and the second core 54 in position. The mechanical deforming step further deforms both the jacket precursor 56 and the second core 54 to form a boattail.

Figure 7:
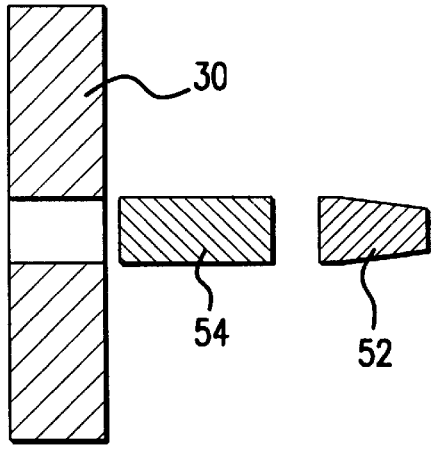
FIGS. 7 and 8 illustrate benefits of the present invention in which the first and second cores are unaffixed.

The first core 52 and the second core 54 are preferably in abutting, but not affixed, relationship. With reference to FIG. 7, when the kinetic energy of the projectile is sufficiently high, that both the first core 52 and the second core 54 penetrate through armored target 30, two projectiles, rather than one, are released within the target significantly increasing damage capability.

Figure 8:
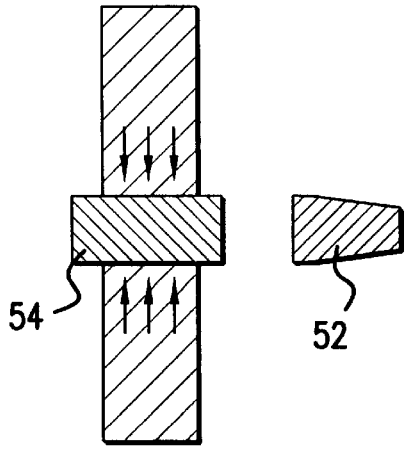
Figure 1:
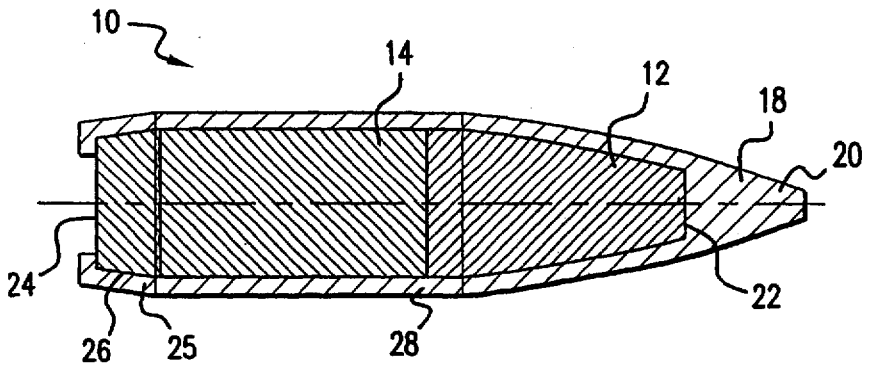
FIG.1 PRIOR ART
Figure 2:
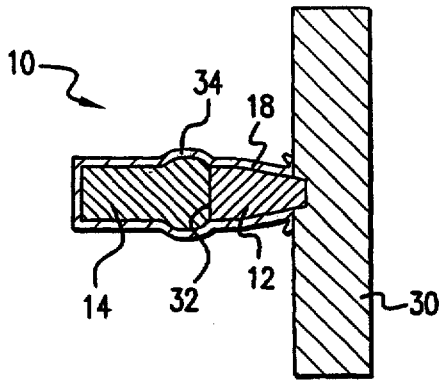
FIG.2 PRIOR ART
Figure 3:
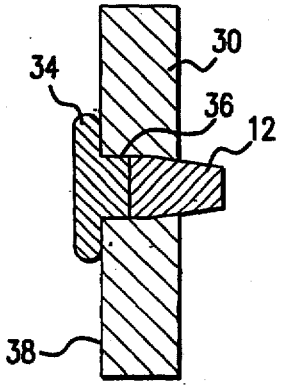
Figure 4:
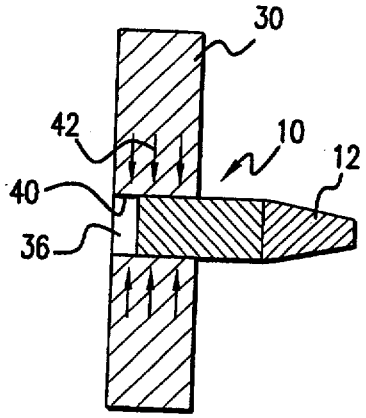
FIG.4 PRIOR ART
Figure 5:
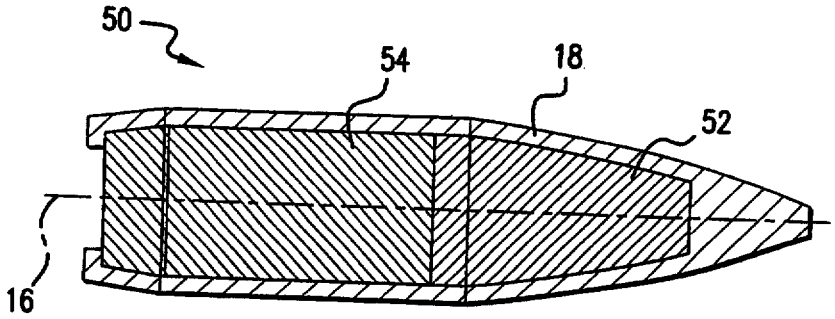

With reference to FIG. 8, if the kinetic energy of the projectile is somewhat less than that possessed by the projectile illustrated in FIG. 7, for example if the distance to the target is longer resulting in a lower projectile velocity at impact, the compressive forces 42 will reduce the kinetic energy of the second projectile 54 to zero, stopping that projectile. The first projectile 52 is still released within the target and is capable of inflicting damage.

The advantages of the invention will become more apparent from the example that follows:

Example

Two lots of 5.56 mm penetrating bullets were formed, both having a brass jacket and a forward steel core. In the control lot, a 32 grain lead slug was tandemly aligned behind the steel core. The resulting control projectile had a mass of 62 grains. In the lot of the invention, a volume of annealed copper alloy C10200 equal to the volume of lead in the control was tandemly aligned behind the steel core. The copper slug had a mass of 25 grains, resulting in a projectile with a mass of 55 grains.

The other dimensions of both lots of projectiles, in inches, were as follows:

| | |
|---|---|
| Projectile length | 0.9070; |
| Boattail length | 0.0900; |
| Steel core length | 0.3200; |
| Ogive length | 0.4260; and |
| Cylindrical mid-body length | 0.3910. |

Due to the reduced mass, the kinetic energy of the lead-free projectile of the invention was 10% less than the kinetic energy of the control. However, when fired at 10 gage steel plates at distances of 600 meters, 650 meters and 700 meters, the two rounds had equivalent penetration capabilities.

It is apparent that there has been provided in accordance with the invention a penetrator projectile that fully satisfies the objects, features and advantages set forth hereinabove. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A small caliber projectile penetrator, comprising:

a one-piece steel first core;

a copper or copper alloy second core in tandem alignment with said first core wherein the hardness of said first core is greater than the hardness of said second core and said second core has a Brinell hardness of between about 20 and about 50; and a jacket enveloping both said first core and said second core, said jacket having an ogival nose portion adjacent to said first core and an angularly indented rear portion adjacent to said second core with a generally cylindrical sidewall disposed between said ogival nose portion and said angularly indented rear portion and in substantially continuous contact with a sidewall of the first core and a sidewall of the second core.

2. The penetrator of claim 1 wherein said first core is hardened steel.

3. The penetrator of claim 2 wherein said second core has a Brinell hardness of from about 35 to about 45.

4. The penetrator of claim 3 wherein said second core is an annealed copper alloy.

5. The penetrator of claim 4 being lead-free.

6. The penetrator of claim 5 wherein said first core and said second core are in abutting, but unaffixed, relationship.

7. The penetrator of claim 1 wherein said second core is an annealed copper alloy.

8. The penetrator of claim 1 wherein said second core is C10200.

9. The penetrator of claim 1 having a mass of about 55 grains.

10. The penetrator of claim 1 being a 5.56 mm caliber bullet.

11. A small caliber projectile penetrator, comprising:

a work hardened steel first core;

a copper or copper alloy second core in tandem alignment with said first core, wherein the hardness of said first core is greater than the said second core and said second core having a Brinell hardness of between about 20 and about 50; and a jacket enveloping both said first core and said second core, said jacket having an ogival nose portion adjacent to said first core and a boattail portion adjacent to said second core with a sidewall disposed between said ogival nose portion and said boattail portion and in substantially continuous contact with a sidewall of the first core and a sidewall of the second core.

12. The penetrator of claim 11 having a mass of about 55 grains.

13. The penetrator of claim 11 wherein a rear end of the first core and a front end of the second core are flat.

14. The penetrator of claim 11 being a 5.56 mm caliber bullet.

15. A method for defeating armor plate utilizing a small caliber projectile penetrator to defeat a steel plate, comprising:

providing a penetrator having:

a work hardened steel first core;

a copper or copper alloy second core in tandem alignment with said first core wherein the hardness of said first core is greater than the hardness of said second core and said second core has a Brinell hardness of between about 20 and about 50; and a jacket enveloping both said first core and said second core, said jacket having an ogival nose portion adjacent to said first core and a boattail rear portion adjacent to said second core with a sidewall disposed between said ogival nose portion and said boattail rear portion and in substantially continuous contact with a sidewall of the first core and a sidewall of the second core; and firing the penetrator at the plate from a distance so that the penetrator impacts the plate with a first kinetic energy whereupon both the first and second cores penetrate the plate, wherein the gauge of the plate and the distance are such that with a second projectile penetrator, identical to the projectile penetrator except in that the second projectile penetrator has a lead core in place of the second core, similarly fired at the plate from the distance so that the penetrator impacts the plate with a second kinetic energy, higher than the first kinetic energy, the lead core substantially fails to penetrate the plate.

* * * * *

UNITED STATES PATENT AND TRADEMARK OFFICE

CERTIFICATE OF CORRECTION

PATENT NO. : 6,085,661
DATED : July 11, 2000
INVENTOR(S) : Henry J. Halverson et al.

It is certified that error appears in the above-identified patent and that said Letters Patent is hereby corrected as shown below:

Title page,
The title page, showing the illustrative figure, should be deleted and substitute therefore the attached title page.

Drawings,
The drawing sheets, consisting of Figs. 1 and 5 should be deleted to be replaced with the drawing sheets, consisting of Figs. 1 and 5, as shown on the attached pages.

Signed and Sealed this

Fourteenth Day of May, 2002

*Attest:*

*Attesting Officer*

JAMES E. ROGAN
*Director of the United States Patent and Trademark Office*

United States Patent [19]

Halverson et al.

[11] Patent Number: 6,085,661

[45] **Date of Patent: *Jul. 11, 2000**

[54] SMALL CALIBER NON-TOXIC PENETRATOR PROJECTILE

[75] Inventors: Henry J. Halverson, Collinsville; Anthony F. Valdez, Godfrey, both of Ill.

[73] Assignee: Olin Corporation, East Alton, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,131

[22] Filed: Oct. 6, 1997

[51] Int. Cl.[7] ..... F42B 12/04

[52] U.S. Cl. ..... 102/516; 102/518; 102/519

[58] Field of Search ..... 102/501, 514–519; 29/1.22, 1.23

[56] References Cited

U.S. PATENT DOCUMENTS

| | | | |
|---|---|---|---|
| 3,782,287 | 1/1974 | Sie | 102/518 |
| 4,619,203 | 10/1986 | Habbe | 102/517 |

FOREIGN PATENT DOCUMENTS

| | | | |
|---|---|---|---|
| 819445 | 8/1969 | Canada | 102/517 |
| 374726 | 6/1907 | France | 102/502 |
| 601686 | 5/1948 | United Kingdom | 102/514 |

OTHER PUBLICATIONS

Baumeister, "Mechanical Engineers'Handbook", Sixth Edition p. 5–5, 1958.

*Primary Examiner*—Harold J. Tudor
*Attorney, Agent, or Firm*—Wiggin & Dana; Gregory S. Rosenblatt

[57] ABSTRACT

A small caliber non-toxic penetrator projectile has a first core and a second core tandemly aligned and enveloped by a jacket. The first core has a hardness greater than the hardness of the second core that has a Brinell hardness of between about 20 and about 50. The hardness of the second core is significantly higher than the hardness of lead and when the first core strikes a target, the second core resists compressive bulging. As a result, more kinetic energy is transferred to the first core rather than diffused along the surfaces of an armored target. The more efficient transfer of kinetic enables the use of lower density second cores, such as annealed copper.

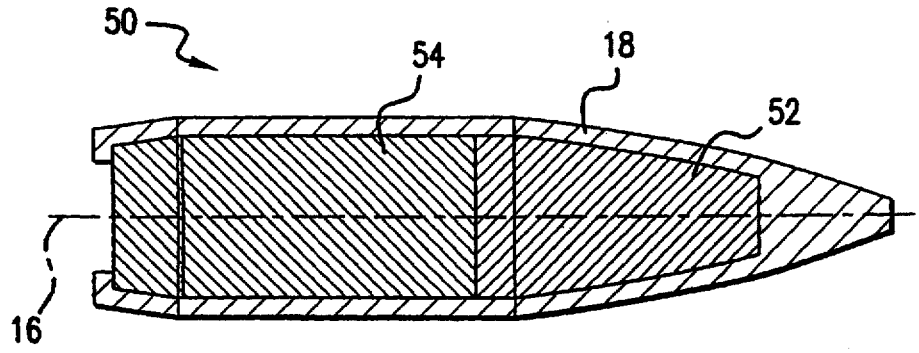

15 Claims, 3 Drawing Sheets